US005913617A

United States Patent [19]

Helstern

[11] Patent Number: 5,913,617

[45] Date of Patent: Jun. 22, 1999

[54] DISPLAY SYSTEM

[75] Inventor: Robert P. Helstern, Costa Mesa, Calif.

[73] Assignee: Eaton Corporation, Cleveland, Ohio

[21] Appl. No.: 08/805,205

[22] Filed: Feb. 27, 1997

[51] Int. Cl.[6] ..... G09F 13/04

[52] U.S. Cl. ..... 40/564; 362/24; 362/28; 200/313

[58] Field of Search ..... 40/564, 580, 315, 40/442; 362/24, 29, 95, 812; 200/311, 313, 314

[56] References Cited

U.S. PATENT DOCUMENTS

| | | | |
|---|---|---|---|
| 3,511,560 | 5/1970 | Hamilton | 359/613 |
| 4,535,396 | 8/1985 | Guthrie | 362/29 X |
| 4,712,163 | 12/1987 | Oxley | 362/29 |
| 5,295,050 | 3/1994 | Helstern et al. . | |
| 5,544,019 | 8/1996 | Tatavoosian et al. | 200/313 X |

*Primary Examiner*—Brian K. Green
*Attorney, Agent, or Firm*—Tarolli, Sundhiem, Covell, Tummino & Szabo

[57] ABSTRACT

A display system includes a light source which is disposed within a housing and a display panel. The display panel includes inner and outer layers. Both the inner and the outer layer contain a light absorbing pigment and a light scattering particulate. The outer layer of the panel contains a greater quantity of pigment than the inner layer. The inner layer of the panel contains a greater quantity of light scattering particulate than the outer layer. The inner and outer layers of the panel having the same optical density. If desired, indicia may be provided between the inner and outer layers of the display panel. In order to increase the viewing angle at which the indicia is visible to an observer, the indicia is formed with sloping minor side surfaces which flare outward from the inner panel toward the outer panel.

15 Claims, 3 Drawing Sheets

DISPLAY SYSTEM

BACKGROUND OF THE INVENTION

The present invention relates to a display system having an improved display panel.

Display systems are commonly utilized in association with push-button actuated switches, annunciators, and signaling devices. A known display system is disclosed in U.S. Pat. No. 5,295,050. This known display system is constructed so as to be readable in bright sunlight. The display system includes a prism having a pair of light receiving faces.

When a source of light is energized in the display system of U.S. Pat. No. 5,295,050, light is transmitted to the light receiving faces of the prism. The light is transmitted through the prism to a light emitting face of the prism. A display panel is disposed in front of the prism. Indicia on the display panel is observable when the source of light is energized, even when the display panel is exposed to bright sunlight. However, the indicia on the display panel is obscured when the source of light is not energized.

SUMMARY OF THE INVENTION

The present invention provides a new an improved display system having a light source which is disposed within a housing. A display panel extends across an opening in the housing. The display panel includes inner and outer layers containing light absorbing pigment and light scattering particulates. The inner and outer layers of the display panel have the same optical density.

In order to minimize specular reflectance from the outer layer of the display panel in bright sunlight, the outer layer of the display panel contains a relatively large amount of pigment in addition to light scattering particulates. In order to provide a relatively wide viewing angle for an observer, the inner layer of the display panel includes a relatively large amount of light scattering particulate and a smaller amount of light absorbing pigment.

A layer of indicia may be provided between the inner and outer layers. The layer of indicia includes opaque areas and transparent areas. However, the opaque areas are not completely opaque to thereby promote diffusion of light so as to increase an observer's angle of view.

BRIEF DESCRIPTION OF THE DRAWINGS

The foregoing and other features of the present invention will become more apparent upon a consideration of the following description taken in connection with the accompanying drawings, wherein.

DESCRIPTION OF ONE SPECIFIC PREFERRED EMBODIMENT OF THE INVENTION

General Description

Figure 1:
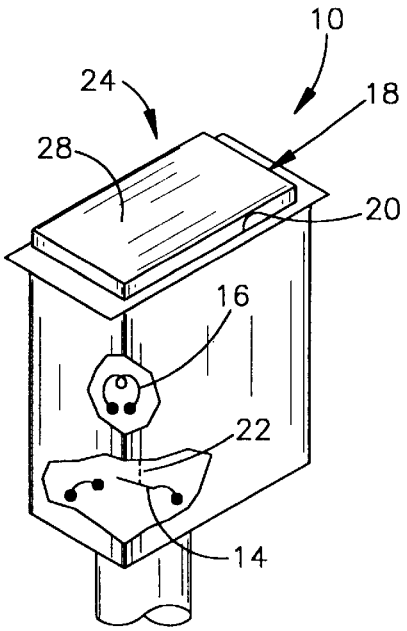
FIG. 1 is a schematic illustration of a switch assembly having a display system constructed in accordance with the present invention.

A switch assembly 10 (FIG. 1) has a rectangular housing 12 which encloses a switch 14 and a light source 16. The light source 16 may be incandescent, such as a bulb, or may be solid state, such as a light emitting diode. A push button 18 extends across an opening 20 in an upper end portion of the housing 12. When the push button 18 is depressed, a mechanism, indicated schematically at 22 in FIG. 1, causes operation of the switch 14 from the illustrated opened condition to a closed condition. Upon operation of the switch 14 to the closed condition, the light source 16 is energized.

When the light source 16 is energized, light propagates to and is refracted through an improved display system 24 in the push button 18. Upon energization of the light source 16, optional indicia in the display system 24 is detectable to an observer positioned anywhere within a one hundred seventy-six (176) degree viewing field relative to the energized display system 24. When the light source 16 is deenergized the indicia in the display system 24 is completely undetectable from any angle of view. When the light source 16 is deenergized, the indicia is undetectable even when the display system 24 is exposed to direct brilliant sunlight from any angle of incidence.

The display system 24 includes a display panel 28 which is constructed in accordance with the present invention. The display panel 28 extends across the opening 20 in the upper end portion of the housing 12.

Figure 2:
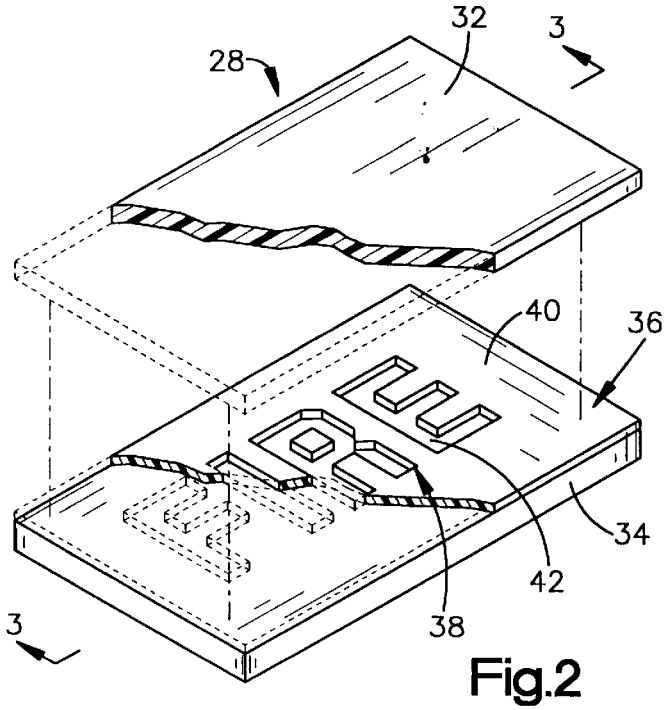
FIG. 2 is an exploded pictorial schematic illustration of a display panel used in the switch assembly of FIG. 1.
Figure 3:
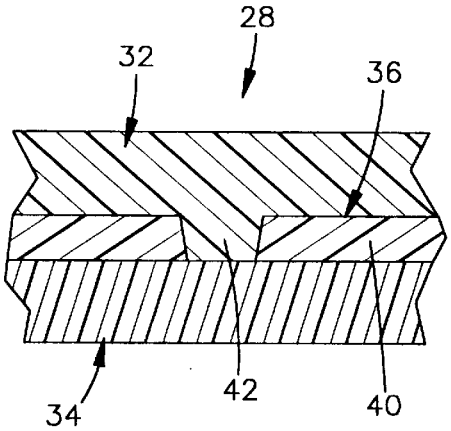
FIG. 3 is a simplified fragmentary sectional view taken generally along the line 3–3 of FIG. 2, illustrating a portion of the display panel with components of the display panel interconnected.

The display panel 28 (FIGS. 2 and 3) has a multilayered construction and includes an outer layer 32 and an inner layer 34. An optional translucent indicia layer 36 is disposed between the outer layer 32 and inner layer 34. The indicia layer 36 includes indicia 38. The indicia 38 is defined by a portion 40 of the translucent indicia layer 36 having a relatively high optical density and a portion 42 of the translucent indicia layer having a relatively low optical density.

In accordance with one of the features of the present invention, both the outer layer 32 and inner layer 34 of the display panel 28 contain light absorbing pigment and light scattering particulate. The outer layer 32 contains a greater quantity of light absorbing pigment than the inner layer 34. The inner layer 34 contains a greater quantity of light scattering particulate than the outer layer 32.

Figure 7:
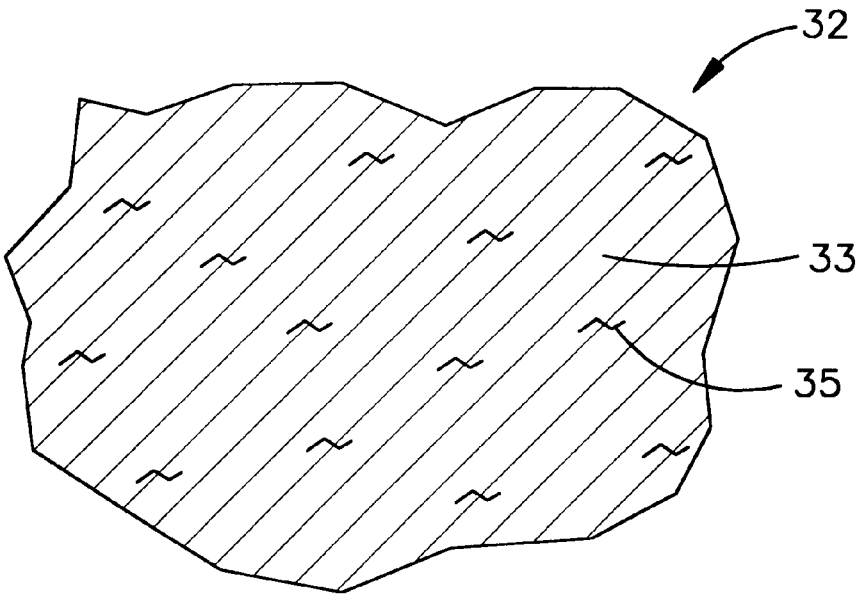
FIG. 7 is an enlarged schematic illustration of a portion of an outer layer of the display panel.
Figure 8:
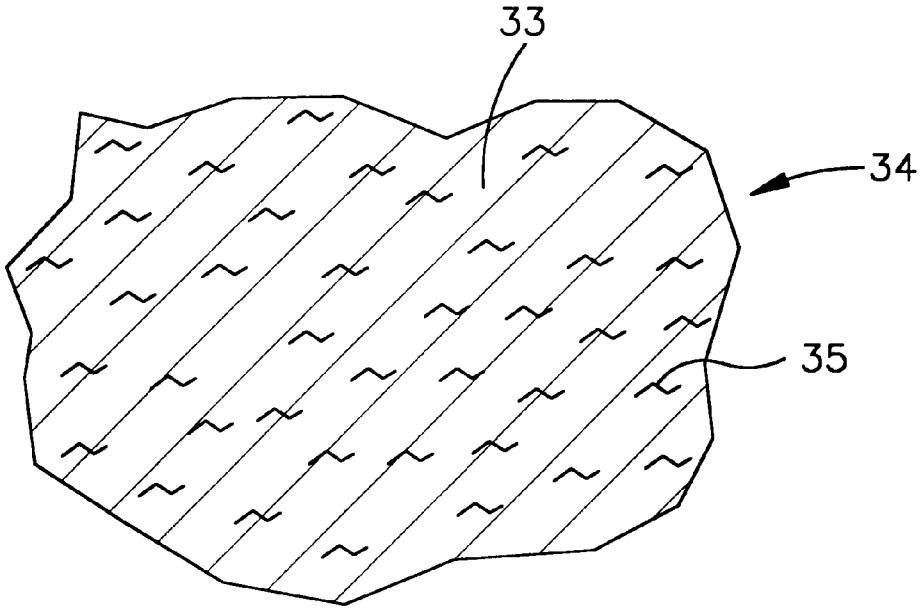
FIG. 8 is an enlarged schematic illustration of a portion of an inner layer of the display panel.

The relatively large quantity of light-asorbing pigment in the outer layer 32 is indicated chematically at 33 in FIG. 7 and the relatively small quantity of light-scattering particulate in the outer layer 32 is indicated schematically at 35 in FIG. 7. The relatively small quantity of pigment in the inner layer 34 is indicated schematically at 33 in FIG. 8 and the relatively large quantity of particulate is indicated schematically at 35 in FIG. 8.

The relatively large quantity of light absorbing pigment in the outer layer 32 promotes attenuation of direct sunlight to maintain the obscurity of the indicia 38. It is particularly advantageous to provide the light scattering particulate in combination with the light absorbing pigment to avoid problems associated with maintaining obscurity of the indicia when high ambient incident light is directed at relatively small angles relative to the normal of the outer layer 32. The light scattering particulate causes dispersion of the light rays in the outer layer 32 to virtually eliminate reflection of light from the indicia layer 36. This eliminates any possibility of an observer falsely perceiving energization of the light source 16 (FIG. 1) when the outer layer 32 (FIGS. 2 and 3) of the display panel 28 is exposed to bright sunlight.

The inner layer 34 contains a greater quantity of light scattering particulate and a lesser quantity of light absorbing pigment than the outer layer 32. The greater quantity of light scattering particulate in the inner layer 34 enables the inner layer to disperse light from the light source 16 to enhance the viewing angle of the display panel 28. The lesser quantity of light absorbing pigment reduces attenuation of light from the source 16 and thereby enhances the brilliance of the display panel 28.

In accordance with another feature of the invention, the outer layer 32 and inner layer 34 of the display panel 28 have the same optical density. This enables the two layers 32 and 34 of the display panel 28 to be optically continuous at the portion 42 of the indicia layer 36 (FIGS. 2 and 3) which has a relatively low optical density. By forming the outer layer 32 and inner layer 34 of material having the same optical density, the eye of an observer cannot detect a discontinuity between the layers.

In accordance with another feature of the invention, the portion 40 of the indicia layer 36 is not completely opaque. Some light can be transmitted through the portion 40 of the indicia layer 36 to reduce any tendency for the portion 40 of the indicia layer to absorb light rather than diffuse light. By having the portion 40 of the indicia layer 36 diffuse rather than absorb light, a limited dispersion affect is obtained on the light being transmitted through the portion 42 having a low optical density area. By diffusing the light with the portion of the indicia layer 40 having a low optical density, the observers angle of view of the indicia 38 is increased.

Although it is believed that it may be preferred to provide the layer 36 of indicia in the display panel 28 when the display panel is used in certain environments, it is believed that there are other environments in which it will be preferred to omit the layer of indicia. When the layer 36 of indicia is omitted, the outer layer 32 is diffusion bonded directly to the upper side surface of the inner layer 34. Since the outer layer 32 and inner layer 34 have the same optical density and are diffusion bonded together at the joint between the layers, the joint between the layers will be free of optical discontinuities.

Exposure of Display System to Sunlight

When the display panel 28 is exposed to direct brilliant sunlight, the sunlight which is not reflected off the outer most surface of the display panel 28 is refracted through the outer layer 32. The sunlight which enters the outer layer 32 is attenuated by the light absorbing pigment and scattered in all directions by the light scattering particulate in the outer layer 32. The amount of sunlight actually reflecting back from the indicia layer 36 and/or the inner layer 34 is highly attenuated and diffused. The amount of reflected sunlight which is actually emitted from the outer layer 32 is so minute and highly diffused that detection of the indicia layer 36 is, for all practical purposes, impossible and the indicia 38 is obscured.

Figure 4:
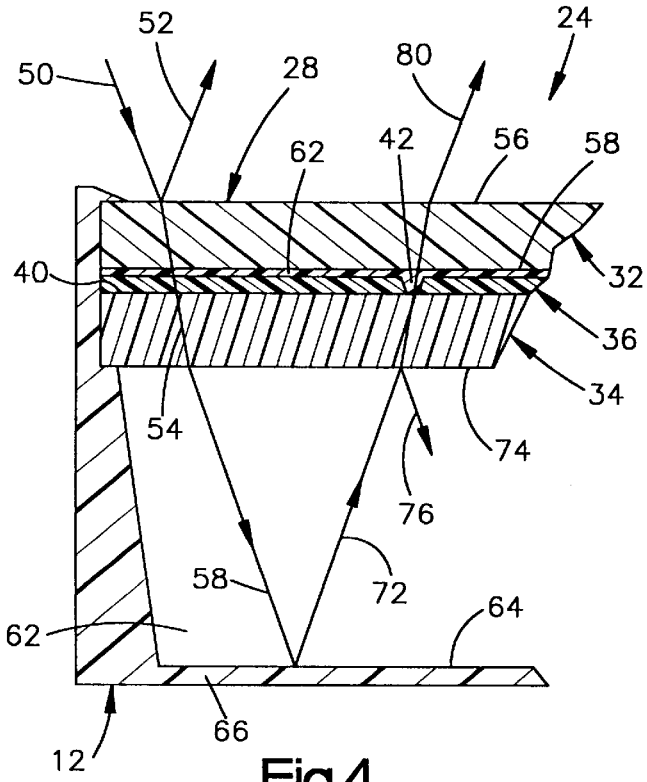
FIG. 4 is a simplified schematic illustration depicting the manner in which a ray of sunlight interacts with the display system of FIG. 1 with a light source in the display system deenergized.

The manner in which a ray 50 of brilliant sunlight interacts with the display system 24 is illustrated schematically in FIG. 4. Approximately four percent (4%) of the light in the ray 50 is reflected in the manner indicated schematically by the light ray 52 in FIG. 4. An anti-reflecting coating is provided on an upper surface 56 of the panel 28 to minimize ambient specular reflection.

As the remaining portion of the ray 50 of sunlight travels through the outer layer 32, in the manner indicated schematically at 54 in FIG. 4, there is a sixty-seven percent (67%) loss in intensity of the ray of sunlight. This is because the outer layer 32 has a transmittance of approximately 33%. Since there was a four percent (4%) reduction in the intensity of the ray of sunlight entering the outer layer 32 due to reflection from an outer side surface 56 of the outer layer 32, this results in the sunlight having approximately thirty-two percent (32%) of its original intensity as the sunlight emerges from a lower surface 58 of the outer layer 32 of the display panel 28.

Upon passing through the lower surface 58 of the outer layer 32 of the display panel 28, the ray of sunlight encounters a clear adhesive layer 62. There is a twelve percent (12%) loss of intensity in the ray of sunlight as it passes through the adhesive layer 62 to the indicia layer 36. Therefore, the ray of sunlight 50 has approximately twenty-eight percent (28%) of its original intensity when the ray of sunlight reaches the indicia layer 36. The adhesive layer 62 is a monomer and blends with the material of the outer layer 32 and indicia layer 36.

Assuming that the ray of sunlight then travels through the portion 40 of the indicia layer 36 having a high optical density, as shown in FIG. 4, there is an eighty-five percent (85%) loss in the intensity of the ray of sunlight. This results in the ray of sunlight having approximately four percent (4%) of its original intensity when it emerges from the indicia layer 36.

The inner layer 34 of the display panel has the same optical density as the outer layer 32 of the display panel. Therefore, there is the same loss in intensity of the ray of sunlight as it passes through the inner layer 34. Thus, there is a sixty-seven percent (67%) loss in intensity of the ray of sunlight as it passes through the inner layer 34. The outer and inner layers 32 and 34 both have a transmittance of approximately 33%. This results in a portion 58 (FIG. 4) of the ray of sunlight having an intensity of approximately one and four tenths percent (1.4%) of its original intensity.

As the ray of sunlight travels through the chamber 62 in the housing 12, the ray of sunlight impinges against a mat 64 on a bottom wall 66 of the housing chamber 62. There is an approximately eighty-five percent (85%) loss in intensity of the sunlight reflected from the mat 64 due to diffusion of the light by the mat. Since there is an eighty-five percent (85%) diffusion at the mat 64, a light ray 72 reflected from the mat 64 has an intensity of approximately 0.2069% of the intensity of the original light ray 50 of brilliant sunlight.

Approximately four percent (4%) of the light ray 72 is reflected from the inner surface 74 of the inner layer 34 of the display panel 28, in the manner indicated at 76 in FIG. 4. This results in approximately 0.20% of the original ray 50 of brilliant sunlight entering the inner layer 34. As the light ray moves through the inner layer 34, there is a sixty-seven percent (67%) loss in intensity. This results in approximately 0.06% of the original light ray 50 entering the adhesive layer 62 at the portion 42 of the indicia layer 36.

In the illustrated embodiment of the invention, the adhesive layer 62 extends into openings formed in the indicia layer 36 to form the portion 42 of the indicia layer having a low optical density. It should be understood that the adhesive layer 62 has been shown schematically in FIG. 4 as being sharply defined. In actual practice, the adhesive layer 62 is formed of a monomer which promotes blending and diffusion bonding of the material of the outer layer 32, indicia layer 36 and inner layer 34. There is approximately a twelve percent (12%) loss in intensity as the light ray passes through the adhesive layer 62. This results in approximately 0.058% of the light ray entering the outer layer 32 of the display panel 28. There is a sixty-seven percent (67%) loss in intensity of the light ray as it passes through the outer layer 32. This results in a light ray 80 emerging from the display panel 28 having an intensity of approximately 0.019% of the intensity of the original light ray 50.

The intensity of the light ray 80 is so low that an observer cannot detect the indicia 38. In addition, the intensity of the light ray 80 is so low that the observer does not incorrectly perceive that the light source 16 is energized even though the display panel 28 is exposed to brilliant sunlight.

The foregoing description of the manner in which a ray of brilliant sunlight interacts with the display system 24 has assumed that a ray of sunlight emerges through the portion 42 of the indicia layer 40 having a low optical density. Of course, if the ray of sunlight emerged through the portion 40 of the layer 36 of indicia having a high optical density, the intensity of the light ray transmitted through the outer panel to an observer would be even less.

The foregoing description has assumed that the layer 36 of indicia is disposed between the outer layer 32 and inner layer 34 of the display panel 28. However, it is believed that in many situations the layer 36 of indicia will be omitted and the outer layer 32 connected directly to the inner layer 34 by a diffusion bonding process. The diffusion bonding process between the outer layer 32 and inner layer 34 in combination with the fact that the outer layer 32 and inner layer 34 have the same optical density results in a joint between the outer layer 32 and inner layer 34 being free of optical discontinuities.

If the indicia layer 36 is omitted, the optical density of the outer layer 32 and the inner layer 34 may be increased by increasing the amount of light absorbing pigment in the outer layer 32 and the amount of light scattering particulate in the inner layer 34. This may be done to make certain that an observer does not mistakenly perceive the light source 16 has being energized when it is deenergized with the display system 24 exposed to brilliant sunlight.

The homogeneous transmission and reflective characteristics of the material for the display panel 28 in combination with the cooperation between light scattering particulates and light absorption pigment, provides a reduction in unwanted interfacial surface reflection of brilliant sunlight within the body of the panel 26. This eliminates the observers ability to detect changes in the contrasting areas or reveal any detail of the panels interior structure when the light source 16 is deenergized. This is independent of the incident angle of ambient sunlight or the observers line of sight.

Energization of Light Source

When the light source 16 is energized, light is transmitted through the display panel 28 to a viewer. The light from the source 16 is widely dispersed. The wide dispersion of the light from the light source 16 is advantageous in providing a wide angle of view to an observer. This results in the light from the source 16 being detectable anywhere within a one hundred seventy-six degree (176°) field of view, even in direct brilliant sunlight.

When the light source 16 is energized, a light ray 90 (FIG. 5) emanates from the light source 16 and is transmitted through the display panel 28 to an observer. The light ray 90 is transmitted through the portion 40 of the indicia layer 36 having a relatively high optical density. When the light ray 90 leaves the display panel 28, it has approximately 1.4% of its original intensity.

In addition to the light ray 90, a light ray 92 (FIG. 5) emanates from the energized light source 16 and is transmitted through the display panel 28. The light ray 92 is transmitted through the portion 42 of the indicia layer 36 having a relatively low optical density. When the light ray 92 leaves the display panel 28, it has approximately 9.6% of its original intensity. The difference in the intensities of the light rays 90 and 92 enables an observer to easily discern the indicia 38.

Considering first the light ray 90, when the light ray impinges against the inner surface 74 of the inner layer 34, approximately four percent (4%) of the light ray is reflected back to the chamber 62. This results in the light ray 90 having ninety-six percent (96%) of its original intensity as the light ray enters the inner layer 34.

As the light ray 90 passes through the inner layer 34, there is a sixty-seven percent (67%) loss of intensity. Therefore, when the light ray 90 leaves the inner layer 34, it has an intensity which is approximately thirty-two percent (32%) of its original intensity.

The light ray 90 then passes through the portion 40 of the indicia layer 36 having a high optical density. As the light ray 90 passes through the portion 40 of the indicia layer 36, there is an eighty-five percent (85%) loss in intensity of the light ray. This results in the light ray having approximately five percent (5%) of its original intensity when the light ray 90 enters the adhesive layer 62.

As the light ray 90 passes through the adhesive layer 62, there is a loss of intensity of approximately twelve percent (12%). This results in the light ray 90 having an intensity of approximately four percent (4%) of its original intensity when the light ray 90 enters the outer layer 32.

As the light ray 90 passes through the outer layer 32, there is a sixty-seven percent (67%) loss in intensity of the light ray. This results in the light ray 90 having an intensity of approximately 1.4% of its original intensity as the light ray exits from the upper surface 56 of the outer layer 32.

The light ray 92 travels directly from the light source 16 through the inner layer 34. It is assumed that there is no appreciable reflection of the light ray from the inner surface 74 of the inner layer 34. As the light ray 92 passes through the inner layer 34 there is a sixty-seven percent loss in intensity of the light ray. This results in the light ray having thirty-three percent (33%) of its original intensity when the light ray enters the portion 42 of the indicia layer 36 having a low optical density. The portion 42 of the indicia layer 36 is formed by the material of the adhesive layer 62.

As the light ray travels through the portion 42 of the indicia layer 36 and the adhesive layer 62, the light ray looses approximately twelve percent (12%) of its intensity. This results in the light ray 92 having approximately twenty-nine percent (29%) of its original intensity when the light ray enters the outer layer 32.

As the light ray 92 passes through the outer layer 32, the light ray looses sixty-seven percent (67%) of its original intensity. This results in the light ray having approximately 9.6% of its original intensity as the light ray 92 moves outward from the outer surface 56 of the outer layer 32. Since the light ray 92 has an intensity which is almost seven times greater than the intensity of the light ray 90, the indicia 38 is clearly discernable by an observer when the light source 16 is energized.

Due to the light scattering particulate in the inner layer 34, light rays are transmitted through the portion 42 of the indicia layer 36 having a relatively low optical density at many different angles relative to the indicia layer 36. This results in the light rays which pass through the indicia 38 being dispersed so as to enable an observer to discern the indicia 38 through a relatively large viewing angle of approximately one hundred and seventy-six degrees (176°).

Indicia Layer

The translucent indicia layer 36 includes the relatively opaque portion 40 having a high optical density and the relatively clear portion 42 having a relatively low optical density. In the embodiment of the invention illustrated in FIG. 6, the clear portion 42 of the indicia layer 36 is formed by clear adhesive which extends from the adhesive layer 62 into the portion 42 of the indicia layer 36.

The relatively opaque portion 40 of the indicia layer 36 has parallel major outer and inner side surfaces 100 and 102. The indicia 38 (FIG. 2) is formed by cutting openings in the indicia layer 36. The openings which are cut in the indicia layer 36 have sloping minor side surfaces 106 (FIG. 6) and 108 which extend between the outer and inner major side surfaces 100 and 102 of the indicia layer 36. The sloping minor side surfaces 106 and 108 flare outward in a direction away from the inner layer 34 and toward the outer layer 32 to promote dispersion of light at a relatively wide angle as it passes through the indicia layer 36. The minor side surface 106 of the indicia layer 36 extends at an acute angle 112 (FIG. 6) relative to the inner major side surface 102 of the indicia layer. Similarly, the minor side surface 106 extends at an obtuse angle 114 relative to the outer major side surface 100 of the indicia layer 36.

The outwardly flaring configuration of the portion 42 of the indicia layer 36 having a low optical density promotes dispersion of the light rays passing through the indicia 38 to enable a viewer to discern the indicia with a wide viewing angle. Although the adhesive layer 62 has been illustrated schematically in FIG. 6 as being sharply defined, it should be understood that the adhesive layer 62 promotes diffusion bonding between the indicia layer 36 and outer layer 32.

Composition of Display Panel Layers

Both the outer layer 32 and the inner layer 34 of the display panel 28 contain light absorbing pigment and light scattering particulate. As the optical density of the suspended non-color (gray) light absorbing pigment increases, in either the outer layer 32 or the inner layer 34, the layer tends to increase in light energy absorption. As the optical density of the suspended light scattering particulate increases in either the outer layer 32 or inner layer 34, the layer tends to increase in light diffusion. Regardless of the total optical density of the outer layer 32 or inner layer 34, the optical density of the two layers must be equal within plus or minus six percent (6%) of the total optical density of the inner layer 34.

In one specific embodiment of the invention, the outer layer 32 was formed of polymerized methyl methacrylate. The light scattering particulate were formed of styrene. The light absorbing pigment was a neutral gray, non-color pigment. The inner layer 34 was also formed of polymerized methyl methacrylate. The light scattering particulate in the inner layer 34 was formed of styrene. The light absorbing pigment in the inner layer 34 was a neutral gray.

In this specific embodiment of the invention, the outer layer 32 contained a non-color (gray) light absorbing pigment having a transmittance of twenty-five percent (25%) to thirty percent (30%). This corresponds to a loss in intensity of 75% to 70%. The outer layer 32 contained a light dispersion particulate (styrene) having a transmittance of seventy percent (70%) to eighty-five percent (85%). This corresponds to a loss in intensity of 30% to 15%. The uncorrected product transmittance of the pigment and light dispersion particulate was 17.5% to 25.5%.

The inner layer contained a non-color (gray) light absorbing pigment having a transmittance of fifty percent (50%) to sixty percent (60%). The inner layer 34 contained a light dispersion particulate (styrene) having a transmittance of forty percent (40%) to forty-five percent (45%). The uncorrected product transmittance of the inner layer 34 was twenty percent (20%) to twenty-five percent (25%).

After the outer layer 32 and inner layer 34 had been interconnected by diffusion bonding without an indicia layer 36, the uncorrected product transmittance values for the inner and outer layers increased by 10 to 11 percentage points. This is due to the reduction of incident reflection and polarization effects on the light.

The outer layer 32 of this specific display panel 28, which did not have an indicia layer 36, had a non-color (gray) pigment transmittance of 35.5 to 40.5%. The outer layer 32 had a light dispersion particulate transmittance of 80.5% to 95.%. The product transmittance of the pigment and light dispersion particulate was 28.5% to 38.6%. The nominal transmittance of the outer layer 32 was 33.5%. Therefore, light traveling through the outer layer 32 would have a loss in intensity of 66.5%. The nominal optical density of the outer layer 32 was 2.9738.

The inner layer 34 had a non-color (gray) pigment transmittance of 60.5% to 70.5%. The inner layer 34 had a light dispersion particle transmittance of 50% to 55%. The inner layer 34 had a product transmittance of 30.2% to 38.7%. The nominal transmittance of the inner layer 34 was 34.5%. Therefore, light traveling through the inner layer 34 would have a loss in intensity of 65.5%. The nominal total optical density of the inner layer 34 was 2.8985.

Figure 6:
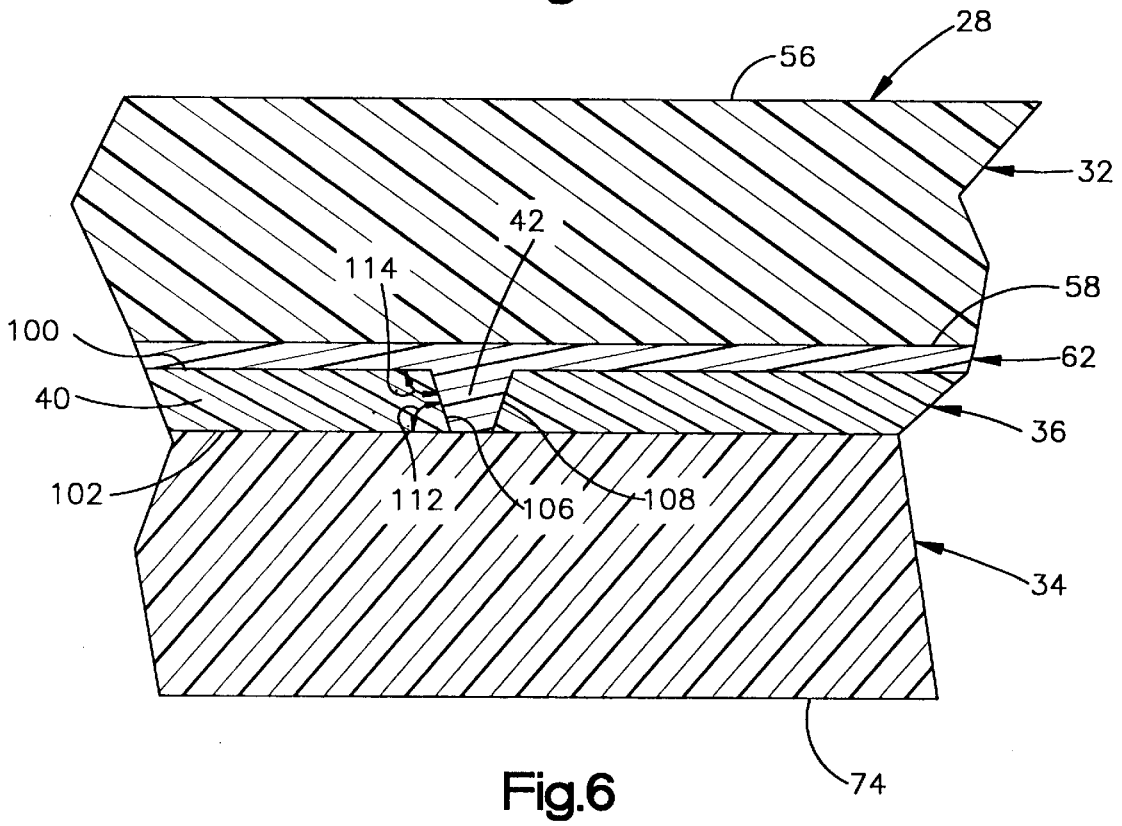
FIG. 6 is an enlarged simplified fragmentary illustration of a portion of the display panel.

In the embodiment of the invention illustrated in FIG. 6, the translucent indicia layer 36 was also formed of polymerized methyl methacrylate. Sufficient color absorbing pigment is provided in the portion 40 of the indicia layer 36 having a high optical density in order to obtain near opacity. However, complete opacity was not reached. Complete opacity would tend to absorb more light rather than diffuse light thereby creating a limited dispersion affect on the transmitted light in the portion 42 of the indicia layer 36 having a low optical density.

Figure 5:
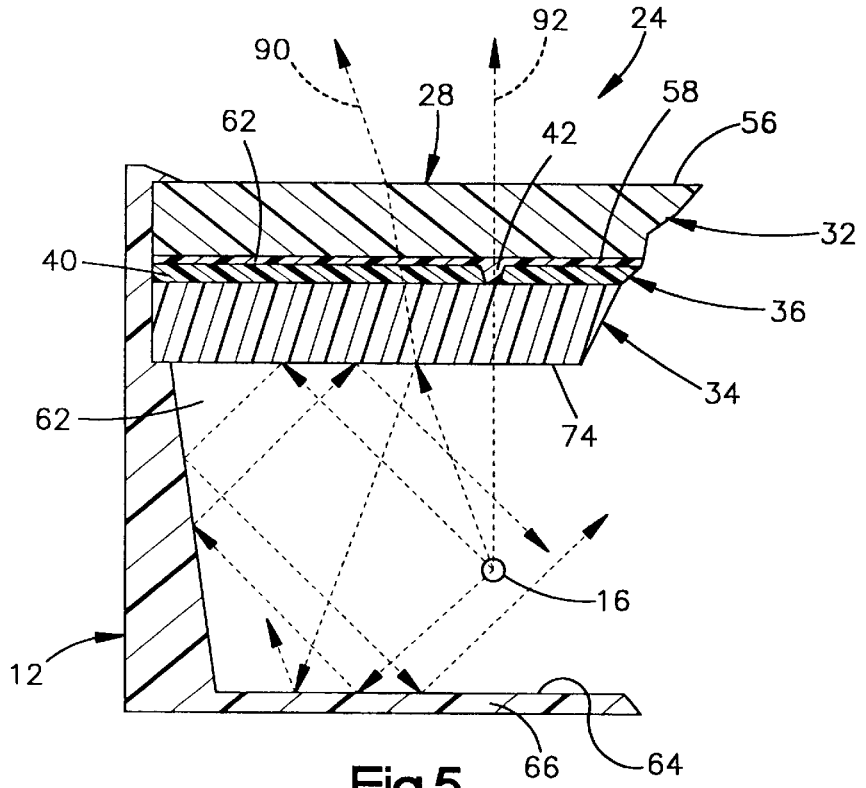
FIG. 5 is a simplified schematic illustration, generally similar to FIG. 4, depicting the manner in which rays of light from the energized light source interact with the display system of FIG. 1.

To form the indicia layer 36 in the embodiment of the invention illustrated in FIGS. 4, 5 and 6, a premixed solution of methyl methacrylate was applied to a roughened outer side of the inner layer 34. The methyl methacrylate solution was then allowed to polymerized to form a relatively opaque layer. Portions of the opaque layer were then removed to form the indicia 38.

The optical density of the methyl methacrylate which forms the indicia layer 36 can be determined by formulation of the solution prior to deposition or by mechanical means to reduce material thickness after polymerization. Reducing the thickness of the indicia layer 36 to control the transmittance of the layer may be particularly advantageous when display panels are to be used with a number of different light sources for different applications. By varying the thickness of the indicia layer 36, depending upon the particular application for which the display panel 28 is to be used, the opacity of the portion 40 of the indicia layer 36 having a high optical density can be varied to suit a particular application without loss of the basic properties of the display panel 28.

Regardless of whether the indicia layer 36 is provided in association with the outer layer 32 and inner layer 34, the inner and outer layers 32 and 34 have substantially the same optical density within plus or minus six percent (6%). In regard to the outer layer 32, the light absorbing pigment optical density is 4 to 3.3 while the light scattering particulate optical density is 1.43 to 1.18. The uncorrected product optical density for the outer layer 32 is 5.7 to 3.9.

The optical density of the light absorbing pigment in the inner layer 34 is less than the optical density of the light absorbing pigment in the outer layer 32. Thus, the optical density of the light absorbing pigment in the inner layer 34 varies in a range of 2 to 1.66. The optical density of the light scattering particulate in the inner layer 34 is greater than the optical density of the light scattering particulate in the outer layer 32. The optical density of the light scattering particulate in the inner layer 34 varies in a range of 2.5 to 2.22. The uncorrected product optical density of the inner layer 34 varies within a range of 5 to 3.7.

CONCLUSION

In view of the foregoing description, it is apparent that the present invention provides a new and improved display system 24 having a light source 16 which is disposed within a housing 12. A display panel 28 extends across an opening 20 in the housing 12. The display panel 28 includes inner and outer layers 34 and 32 containing light absorbing pigment and light scattering particulates. The inner and outer layers 34 and 32 of the display panel 28 have the same optical density.

In order to minimize specular reflectance from the outer layer 32 of the display panel 28 in bright sunlight, the outer layer of the display panel contains a relatively large amount of pigment in addition to light scattering particulates. In order to provide a relatively wide viewing angle for an observer, the inner layer 34 of the display panel 28 includes a relatively large amount of light scattering particulate and a smaller amount of light absorbing pigment.

A layer 36 of indicia may be provided between the inner and outer layers 34 and 32. The layer 36 of indicia includes opaque areas 40 and transparent areas 42. However, the opaque areas 40 are not completely opaque to thereby promote diffusion of light so as to increase an observer's angle of view.

Having described the invention, the following is claimed:

1. A display system comprising a housing, a light source disposed within said housing, and a display panel connected with said housing, said display panel having inner and outer layers containing a light absorbing pigment and a light scattering particulate, each unit of volume of said outer layer of said display panel containing a greater quantity of light absorbing pigment than a corresponding unit of volume of said inner layer, each unit of volume of said inner layer of said display panel containing a greater quantity of light scattering particulate than a corresponding unit of volume of said outer layer, said inner and outer layers of said display panel having substantially the same optical density.

2. A display system as set forth in claim 1 wherein said first and second layers of said display panel are interconnected at a location which is free of optical discontinuities.

3. A display system as set forth in claim 1 wherein said inner layer is diffusion bonded to said outer layer.

4. A display system comprising a housing, a light source disposed within said housing, and a display panel connected with said housing, said display panel having inner and outer layers containing a light absorbing pigment and a light scattering particulate, each unit of volume of said outer layer of said display panel containing a greater quantity of light absorbing pigment than a corresponding unit of volume of said inner layer, each unit of volume of said inner layer of said display panel containing a greater quantity of light scattering particulate than a corresponding unit of volume of said outer layer, said inner and outer layers of said display panel having substantially the same optical density, said display panel having a layer of indicia disposed between said inner and outer layers, said layer of indicia including first and second translucent portions, said first translucent portion of said layer of indicia having an optical density which is greater than the optical density of said inner and outer layers, said second translucent portion of said layer of indicia having an optical density which is less than the optical density of said first translucent portion of said layer of indicia.

5. A display system as set forth in claim 4 wherein said outer layer of said display panel has a light transmittance of approximately 33 percent and said inner layer of said display panel has a light transmittance of approximately 33 percent.

6. A display system as set forth in claim 4 further including an adhesive layer disposed between said indicia layer and one of said inner and outer layers.

7. A display system as set forth in claim 6 wherein said adhesive layer has an optical density which is less than the optical density of said inner and outer layers.

8. A display system as set forth in claim 7 wherein said second translucent portion of said layer of indicia has an optical density which is at least half as great as the optical density of said outer layer.

9. A display system comprising a housing, a light source disposed within said housing, and a display panel connected with said housing, said display panel having inner and outer layers containing a light absorbing pigment and a light scattering particulate, each unit of volume of said outer layer of said display panel containing a greater quantity of light absorbing pigment than a corresponding unit of volume of said inner layer, each unit of volume of said inner layer of said display panel containing a greater quantity of light scattering particulate than a corresponding unit of volume of said outer layer, said inner and outer layers of said display panel having substantially the same optical density, said display panel having a layer of indicia disposed between said first and second layers, said layer of indicia having a first portion with a first optical density and a second portion with a second optical density which is less than the first optical density, said first portion of said layer of indicia has an inner major side which faces toward said inner layer, an outer major side which faces toward said outer layer and a minor side which extends between said inner and outer major sides, said minor side of said first portion of said layer of indicia extending at an acute angle to said inner major side of said first portion of said layer of indicia and extending at an obtuse angle to said outer major side of said first portion of said layer of indicia.

10. A display system comprising a housing, a light source disposed within said housing, and a display panel connected with said housing, said display panel having inner and outer layers containing a light absorbing pigment and a light scattering particulate, each unit of volume of said outer layer of said display panel containing a different quantity of light absorbing pigment than a corresponding unit of volume of said inner layer, each unit of volume of said inner layer of said display panel containing a different quantity of light scattering particulate than a corresponding unit of volume of said outer layer, said inner and outer layers of said display panel having substantially the same optical density.

11. A display system as set forth in claim 10 wherein said inner and outer layers of said display panel are interconnected at a location which is free of optical discontinuities.

12. A display system as set forth in claim 10 further including a layer of indicia disposed between said inner and outer layers, said layer of indicia including first and second translucent portions, said second translucent portion of said layer of indicia having an optical density which is less than the optical density of said first translucent portion of said layer of indicia.

13. A display system as set forth in claim 12 wherein said first portion of said layer of indicia has an inner major side which faces toward said inner layer, an outer major side which faces toward said outer layer and a minor side which extends between said inner and outer major sides, said minor side of said first portion of said layer of indicia extending at an acute angle to said inner major side of said first portion of said layer of indicia and extending at an obtuse angle to said outer major side of said first portion of said layer of indicia.

14. A display system as set forth in claim 10 wherein said inner layer is diffusion bonded to said outer layer.

15. A display system as set forth in claim 10 wherein said outer layer of said display panel has a light transmittance of approximately 33 percent and said inner layer of said display panel has a light transmittance of approximately 33 percent.

* * * * *